United States Patent [19]

French

[11] 4,305,753

[45] Dec. 15, 1981

[54] PROCESS FOR PRODUCING FERROMAGNETIC METALLIC PARTICLES

[75] Inventor: James E. French, Newark, Del.

[73] Assignee: Hercules Incorporated, Wilmington, Del.

[21] Appl. No.: 174,046

[22] Filed: Jul. 31, 1980

[51] Int. Cl.[3] ..... B22F 9/00

[52] U.S. Cl. ..... 75/0.5 AA; 148/105; 252/62.55

[58] Field of Search ..... 75/0.5 AA, 0.5 BA; 148/105; 252/62.55, 62.56; 427/127; 428/900

[56] References Cited

U.S. PATENT DOCUMENTS

| | | | |
|---|---|---|---|
| 3,598,568 | 8/1971 | Klomp et al. | 75/0.5 AA |
| 3,607,220 | 9/1971 | Van Der Giessen et al. | 75/0.5 AA |
| 3,702,270 | 11/1972 | Kawasaki et al. | 148/105 |
| 3,837,839 | 9/1974 | Rau et al. | 75/0.5 AA |
| 4,069,073 | 1/1978 | Tadokoro et al. | 252/62.56 |
| 4,155,748 | 5/1979 | Steck et al. | 75/0.5 AA |
| 4,165,232 | 8/1979 | Jaeckh et al. | 75/0.5 AA |

FOREIGN PATENT DOCUMENTS

| | | |
|---|---|---|
| 743792 | 1/1956 | United Kingdom . |
| 1125093 | 8/1968 | United Kingdom . |
| 2016526 | 9/1979 | United Kingdom . |

*Primary Examiner*—L. Dewayne Rutledge
*Assistant Examiner*—John P. Sheehan
*Attorney, Agent, or Firm*—Hazel L. Deming

[57] ABSTRACT

Described is an improved process for producing acicular ferromagnetic metallic particles by the reduction of acicular particles of iron oxide or iron oxide hydrate with a gaseous reducing agent. More specifically, the process concerns the improvement wherein the iron oxide or iron oxide hydrate particles are treated with a specified amount of a phosphorus compound and a compound of cobalt, nickel and/or copper prior to the reduction step.

7 Claims, No Drawings

PROCESS FOR PRODUCING FERROMAGNETIC METALLIC PARTICLES

This invention relates to the production of ferromagnetic metallic particles and more particularly to an improved process for preparing acicular metallic particles suitable for magnetic recording media by the reduction of acicular particles of iron oxide or iron oxide hydrate with a gaseous reducing agent.

It is known that iron powders can be produced by the reduction of finely divided acicular particles of iron oxides with hydrogen or some other gaseous reducing agent. Generally, the reduction is carried out with hydrogen, at a temperature above 350° C. in order to achieve complete reaction within a practical time period. However, since interparticle sintering of iron begins to occur at a temperature of about 300° C., careful control of processing parameters, and particularly temperature, time and hydrogen flow rate must be practiced to minimize sintering and avoid appreciable change in the shape and size of the particles. Further, as a consequence of sintering, the coercive force and the ability of the metallic particles to retain their magnetization are considerably reduced and the magnetic properties characteristic of acicular iron particles are not realizable in full.

Various procedures have been suggested in the art for shortening the reduction period and/or lowering the temperature at which iron oxide particles are reduced in order to minimize sintering. For example, British Pat. No. 743,792 proposes mixing powdered iron oxide, preferably in hydrated form, with an organic salt of cobalt or nickel which is decomposable at temperatures between 300° and 425° C. and heating the mixture in a reducing atmosphere at 300° to 425° C. A slightly different procedure is described in German OLS No. 2,212,934 and concerns depositing a coating of a cobalt or nickel compound on the hydrated iron oxide particles by precipitation or evaporation prior to reduction, and further, U.S. Pat. No. 3,702,270 to Kawasaki et al teaches dehydrating particles of hydrated ion oxide which have been treated with cobalt or nickel at a pH of 8.5–11.5, at 600° to 750° C. prior to the reduction step. Other prereduction treatments which have been proposed for the iron oxide particles include aqueous stannous chloride (U.S. Pat. No. 3,607,220 to Van Der Giessen et al), a combination of phosphoric acid and a carboxylic acid (U.S. Pat. No. 4,155,748 to Steck et al), and an oxyacid of boron with or without a phosphoric acid-carboxylic acid combination (U.S. Pat. No. 4,165,232 to Jaeckh et al). Yet another procedure which has been proposed for improving the magnetic properties of metallic particles involves reducing special doped coprecipitates of iron. Metal dopants which are catalytic for hydrogen reactions such as cobalt, nickel, ruthenium, platinum and paladium are taught in U.S. Pat. No. 3,837,839 to Rau et al; germanium, tin and aluminum are taught by U.S. Pat. No. 3,598,568 to Klomp et al; and high ratios of cobalt are taught by British Pat. No. 1,125,093. Iron particles produced by the reduction of iron oxide or iron oxide hydrate particles which have been doped or treated in accordance with the prior art procedures have improved magnetic properties over particles produced from non-doped or untreated oxides. However, sintering of the iron particles during the reduction stage still remains to be a problem of major concern and the search continues for methods which will provide the optimum particle shape and size for maximized magnetic properties.

Now in accordance with this invention, it has been found that the problem of sintering during reduction can be avoided and that magnetic iron particles having improved coercivity and remanence magnetization can be obtained by treating the acicular iron oxides prior to reduction with a water-soluble phosphorus compound and a compound of cobalt, nickel or copper. The finding that sintering resistance and hence improved magnetic properties can be obtained in this manner was completely unexpected since similar results are not realized when any amount of either the phosphorus compound or the cobalt, nickel or copper compound is used singly.

Accordingly, the present invention relates to an improved process for producing acicular ferromagnetic metallic particles suitable for magnetic recording media by reducing acicular particles of iron oxide or iron oxide hydrate with a gaseous reducing agent, wherein the improvement comprises treating said iron oxide or iron oxide hydrate particles prior to the reduction step with a water-soluble phosphorus-containing compound and with at least one compound of a metal selected from the group consisting of cobalt, nickel and copper under conditions to provide on the surface of the oxide particles a coating containing, based on iron, from 0.1 to 5 atomic % of phosphorus and at least 0.1 atomic % of said metal, the atomic ratio of said metal to phosphorus ranging from 0.5:1 to 10:1.

The iron oxide or iron oxide hydrate particles used as the starting material for the process of this invention are acicular in shape and can be any magnetic or non-magnetic oxide of iron which can be reduced to metallic iron. Preferred iron oxides and iron oxide hydrates are alpha-$Fe_2O_3$, gamma-$Fe_2O_3$, $Fe_3O_4$, alpha-FeOOH, gamma-FeOOH, and mixtures thereof in the form of particles having a diameter of 0.01 to 0.1 micron, a length of 0.05 to 5 microns, a length to diameter ratio of at least 3:1 and most preferably from 5:1 to 50:1 and a reduced surface area by the nitrogen BET method of from 10 to 80, and more preferably from 15 to 50 $m^2/g$. The starting oxide or hydrate can also contain small amounts up to 20% or more of modifying elements such as cobalt, nickel and other metals, provided that such elements do not interfere with the acicular shape or the reducibility of the iron oxide. Acicular particles of these oxides are well known and are available commercially.

In carrying out the process of this invention, the iron oxide particles are treated with both a phosphorus compound and a specified metal compound under conditions to provide a deposited coating containing both phosphorus and the metal. The preferred phosphorus-containing compounds are phosphoric acid or the water-soluble inorganic salts thereof, such as the mono-, di- or tri-alkali metal phosphates and specifically dihydrogen phosphate, disodium ortho phosphate, trisodium phosphate, sodium pyrophosphate, sodium metaphosphate and the like. Usually, the phosphorus-containing compound will be added as a dilute aqueous solution to an aqueous dispersion of the iron oxide particles and the amount used should be sufficient to provide from 0.1 to 5 and preferably from about 0.2 to about 2 atomic % phosphorus based on the iron.

Compounds of cobalt, nickel and copper which can be used in the process of this invention include any water-soluble or water-dispersible compound such as the sulfate, chloride, acetate, oxide, hydroxide, nitrate and phosphate of the above metals. Particularly preferred are cobaltous sulfate, cobaltous hydrate, nickelous sulfate, nickelous hydrate and cuperic sulfate. Generally, and such is preferred, the cobalt, iron or copper compound is added as an aqueous solution or dispersion. The amount of cobalt, nickel or copper compound used should be sufficient to provide a deposited coating containing at least 0.1, preferably from 0.1 to about 20 and more preferably from about 0.5 to about 5 atomic % of the metal based on the iron and the amount should also be sufficient to provide a metal to phosphorus ratio of 0.5 to 10. Metal to phosphorus ratios less than or greater than those recited have not been found to provide additional advantages and hence are not recommended.

The treatment step is preferably carried out in aqueous medium at a temperature range of about 25° to 100° C. with agitation to achieve uniform distribution. The order of addition of the phosphorus compound and the compound of cobalt, nickel or copper is not critical and, if desired, can be simultaneously or consecutively and incrementally. Generally, it has been found advantageous to add the phosphate compound gradually with agitation, and to continue agitation for a short period of time before and after the addition of the metal compound to ensure uniformity. Usually, when the phosphorus compound is added first, it is desirable to adjust the pH to at least 5 and preferably to at least 7, just prior to or immediately following the addition of the metal compound.

Further, improvement in the magnetic stability of the metallic particles produced in accordance with this invention can also be realized by including in the treatment step a zinc compound, generally in an amount to provide from about 0.1 to about 10 and preferably from about 1 to about 5 atomic % zinc based on iron. The inclusion of zinc is particularly advantageous when storage of the particles for extended periods of time, especially under conditions of high humidity, is contemplated. Usually, when the zinc compound is used, it will be added as an aqueous solution or dispersion following addition of the cobalt, nickel or copper compound and the addition of the total amount of phosphorus desired will be carried out in two stages, i.e., before and after the addition of the cobalt, nickel or copper compound. Any zinc compound which is water soluble or readily dispersible in water, such as, for example, zinc sulfate, zinc oxide, zinc chloride or zinc acetate can be used.

Following treatment of the iron oxide particles with the phosphorus compound and the metal compound, with or without a zinc compound, the particles can be separated from the aqueous medium conventionally, as by running the slurry or dispersion through a filter press, screen, etc. or by centrifuging, and the recovered particles are washed, dried and then usually crushed to break up any agglomerates.

Conversion of the treated particles to ferromagnetic iron particles is conventional and can be conveniently carried out by charging the particles to a furnace, heating to remove any water of hydration and then heating in a strong reducing atmosphere to reduce the oxide to metal. This can be accomplished by passing a gaseous reducing agent, preferably hydrogen, over the oxide at a temperature from about 250° C. to 500° C., preferably about 300° to about 400° C., for 1 to 8 hours. Following reduction, the metal particles are recovered conventionally, usually by cooling in an inert atmosphere and then slowly passivated at room temperature with a nitrogen-oxygen mixture or by anerobically transfering the cooled particles into an inert solvent such as toluene, filtering in air and then slowly drying the damp particles.

If desired, the treated particles can be dehydrated in a non-reducing atmosphere at elevated temperature prior to the reduction step in order to reduce the porosity of the iron oxide particles. Generally, dehydration in an atmosphere of air or nitrogen at a temperature of 500° to 700° C. for 10 minutes to about 12 hours or longer will provide a reduction of porosity without significant inter-particle sintering. The dehydration step can be carried out as a separate step but is conveniently combined with the reduction step in a conventional furnace operation.

The acicular ferromagnetic metallic particles produced in accordance with this invention contain iron as the major metallic ingredient and are particularly useful for magnetic recording tape manufacture. The particles have excellent magnetic properties of which the coercivity, remanence magnetization and magnetization retention are outstanding and substantially improved over the properties of particles produced from iron oxides treated according to the prior art procedures.

The invention is further illustrated by the following examples wherein all percentages are by weight unless otherwise indicated. The magnetic properties of the metallic particles were measured by a PAR vibrating sample magnetometer at a packing density of 0.7–0.8 gm/cm$^3$. The coercive force, $H_c$ (oersteds) was measured at a field strength of 10,000 oersteds, and the remanence magnetization, $\delta_r$(emu/gram) and saturation magnetization, $\delta_s$ (emu/gram) were measured at at a field strength of 5,000 oersteds (5K) and 10,000 oersteds (10K).

EXAMPLE 1

A vessel equipped with an agitator, heating means and a thermometer was charged with 44.5 grams of acicular alpha-FeOOH particles having an average diameter of about 0.03 micron, a length to diameter ratio of about 10 to 1 and a specific surface area by the nitrogen BET method of 24 m$^2$/g. and 700 ml. of water. Agitation was commenced, the charge was heated to 75° C., and sufficient 4% aqueous sodium hydroxide was added to adjust the pH to 5.3. Next, 3.75 ml. of 1 M phosphoric acid (equivalent to 0.75 atomic % phosphorus based on iron) were added gradually, the slurry was agitated for 15 minutes, the pH of the slurry was adjusted to 7.2 with aqueous sodium hydroxide, 12.0 ml. of 1 M cobalt sulfate solution (equivalent to 2.4 atomic % of cobalt based on iron) were added and the slurry was agitated for an additional 15 minutes. Next, 6.00 ml. of 1 M phosphoric acid were added, the slurry was agitated for 15 minutes, the pH was adjusted to 9.3 with 4% aqueous sodium hydroxide and agitation was continued for 3 minutes. The slurry, following cooling, was filtered, the filter cake was washed free of soluble salts (the washings had a pH of 7) and the washed cake was dried at 50° C. under vacuum. Analyses on the dried cake showed that it contained 58.6% iron and, based on the iron, 1.3 atomic % phosphorus and 2.4 atomic % cobalt. The dried cake was crushed and a portion of the crushed material was transferred to a tubular furnace and reduced for 2.5 hours at 370° C. using a hydrogen stream of 3 liters/minute. The reduced product was transferred anerobically into toluene, then filtered in air and the damp product was dried on the filter overnight.

The resulting product was acicular iron particles having essentially the same particle shape as the starting alpha-FeOOH particles. There was no evidence of sintering but the particles were somewhat porous.

EXAMPLES 2–3

In these examples, the procedure of Example 1 was repeated with the exception that an equal amount of 1 M copper sulfate solution (Example 2) or 1 M nickelous sulfate solution (Example 3) was substituted for the cobalt sulfate solution of Example 1. Analyses on the dried products gave the following values:

| Element | Ex. 2 | Ex. 3 |
|---|---|---|
| Iron, % by wt. | 58.8 | 58.5 |
| Phosphorus, atomic % based on iron | 1.3 | 1.2 |
| Copper, atomic % based on iron | 2.4 | — |
| Nickel, atomic % based on iron | — | 2.3 |

The reduced particles of this example were acicular and had essentially the same shape as the alpha-FeOOH particles.

Comparison Example A

Example 1 was repeated except that the cobalt sulfate addition step was omitted, and the crushed cake was reduced at 370° C. for 4.5 hours. The dried product, prior to reduction, contained 59.5% iron and, based on the iron, 0.7 atomic % phosphorus, indicating that only about one-third of the phosphorus was retained on the particles. The reduced particles were severly sintered.

Comparison Example B

Example 1 was repeated except that the two phosphoric acid addition steps were omitted. In repeating this comparison Example, the pH of the initial slurry at 75° C. was adjusted directly to 7.2, the slurry was agitated for 30 minutes, 12.0 ml. of 1 M cobalt sulfate solution were added and agitation was continued for 15 minutes prior to adjustment of the pH to 9.3. The dried product contained 59.4% iron and, based on the iron, 2.2 atomic % of cobalt. The reduced product had a beady, sintered appearance.

Example 4

Another portion of the crushed dried cake produced in Example 1 was transferred to a tubular furnace and heated for 2 hours at 600° C. under nitrogen, the temperature of the furnace was lowered to 370° C., and heating was continued at 370° C. for 2.5 hours using a reducing atmosphere of 3 liters of hydrogen per minute. The resulting product was acicular iron particles having essentially the same particle shape as the starting alpha-FeOOH particles and less porosity than the particles of Example 1.

Comparison Example C

The procedure of Example 4 was repeated except that a portion of the crushed dried cake produced in comparison Example B was substituted for the crushed cake of Example 1. The resulting product was similar to that of comparison Example B and had a beady, sintered appearance.

The compositional analyses and the magnetic properties of the iron particles produced in Examples 1 to 4 and in comparison Examples A to C are reported below in Table I.

TABLE I

| Ex. No. | Composition, % by weight: Element | % | Magnetic Properties: Hc | $\delta_r$, emu/g 5K | $\delta_r$, emu/g 10K | $\delta_s$, emu/g 5K | $\delta_s$, emu/g 10K | $\delta_r/\delta_s$ at 5K |
|---|---|---|---|---|---|---|---|---|
| 1 | Fe | 79 | 1089 | 63 | 63 | 126 | 140 | 0.50 |
| | P | 0.61 | | | | | | |
| | Co | 2.0 | | | | | | |
| 2 | Fe | 79 | 1090 | 62 | 62 | 124 | 137 | 0.50 |
| | P | 0.60 | | | | | | |
| | Cu | 2.1 | | | | | | |
| 3 | Fe | 80 | 1050 | 62 | 62 | 124 | 137 | 0.50 |
| | P | 0.58 | | | | | | |
| | Ni | 2.1 | | | | | | |
| A | Fe | 92 | 375 | 21 | 21 | 107 | 163 | 0.20 |
| | P | 0.35 | | | | | | |
| B | Fe | 88 | 795 | 62 | 62 | 140 | 158 | 0.44 |
| | Co | 2.0 | | | | | | |
| 4 | Fe | 85 | 1140 | 71 | 71 | 139 | 153 | 0.51 |
| | P | 0.65 | | | | | | |
| | Co | 2.2 | | | | | | |
| C | Fe | 89 | 870 | 67 | 67 | 142 | 162 | 0.47 |
| | Co | 2.1 | | | | | | |

A comparison of the data of the table above clearly demonstrates that metallic particles having higher coercivities and significantly superior squareness ($\delta_r/\delta_s$) are obtained by the practice of this invention and that similar improvement in these properties is not realizable when the same amount of either the phosphorus compound or the metal compound is used singly.

Example 5

The vessel of Example 1 was charged with 44.5 grams of acicular alpha-FeOOH particles having an average diameter of 0.03 micron, a length to diameter ratio of 10 to 1 and a specific surface area by the nitrogen BET method of 24 $m^2/g$. and 700 ml. of water. Agitation was commenced, the charge was heated to 75° C. and the pH of the resulting slurry was adjusted to 5.3 with 4% aqueous sodium hydroxide. Next, 3.75 ml. of 1 M phosphoric acid (equivalent to 0.75 atomic % phosphorus based on iron) were added gradually, the slurry was agitated for 15 minutes, the pH was adjusted to 7.2 with the aqueous sodium hydroxide, 12.0 ml. of a 1 M cobalt sulfate solution (equivalent to 2.4 atomic % cobalt based on iron) were added and the slurry was agitated for an additional 15 minutes. Then 6.0 ml. of 1 M phosphoric acid (equivalent to 1.2 atomic % phosphorus based on iron) were added, the slurry was agitated for an additional 15 minutes, the pH was adjusted to 8.2 with aqueous sodium hydroxide and the slurry was agitated for 30 minutes. Next, 25 ml. of a 1 M zinc sulfate solution (equivalent to 5.0 atomic % of zinc based on iron) were added to the slurry, the slurry was agitated for 15 minutes, the pH was adjusted to 9.3 with aqueous sodium hydroxide and agitation was continued for an additional 30 minutes. The slurry was filtered, the filter cake was washed free of soluble salts (the washings had a pH of 7), and the washed cake was dried in a vacuum oven at 50° C. Analyses on the dried cake showed that it contained 56% iron and, based on the iron, 1.9 atomic % phosphorus, 2.4 atomic % cobalt and 5.0 atomic % zinc. The dried cake was crushed and then dehydrated by heating for 2 hours at 600° C. under nitrogen. A portion of the dehydrated material was transferred to a tubular furnace and heated for 6 hours at 370° C. in the presence of a hydrogen stream of 3 liters/minute, after which time the product was transferred anerobically to toluene, filtered and then dried overnight. The resulting reduced product comprised acicular iron particles having essentially the same particle shape as the starting alpha-FeOOH particles, contained 82% iron, 0.88% phosphorus, 2.1% cobalt and 5.0% zinc, based on product weight, and exhibited the following magnetic properties when measured in the same manner as Examples 1–4:

Coercivity ($H_c$)—1114 oersteds
Remanence magnetization[1] ($\delta_r$)—65 emu/g
Saturation magnetization[1] ($\delta_s$)—147 emu/g
Squareness ($\delta_r/\delta_s$)[2]—0.50

[1]measured at a field strength of 10,000 oersteds
[2]measured at a field strength of 5,000 oersteds The metallic particles produced in this example were also tested for corrosion resistance by exposing a 1/16" layer of the particles in a petri dish in a humidity chamber for 4 weeks at 40.5° C. and 95% relative humidity. The saturation magnetization after the exposure period was 86% of the magnetization prior to exposure.

EXAMPLE 6

The procedure of Example 5 was repeated except that: 4.65 grams of a 25% aqueous dispersion of cobalt hydrate were substituted for the 12.0 ml. of 1 M cobalt sulfate; 8.37 grams of a 25% aqueous dispersion of zinc oxide were substituted for the 25 ml. of 1 M zinc sulfate; and following the reduction step the product was slowly passivated at room temperature with a nitrogen-oxygen mixture. The dried cake of this example contained 55.6% iron, and based on the iron, 1.2 atomic % phosphorus, 2.4 atomic % cobalt, and 5.0 atomic % zinc. The reduced product comprised iron particles having essentially the same shape as the starting alpha-FeOOH particles, contained 83% iron, 0.55% phosphorus, 2.1% cobalt and 4.9% zinc and exhibited the following magnetic properties:

Coercivity ($H_c$)—1150 oersteds
Remanence magnetization[1] ($\delta_r$)—70 emu/g
Saturation magnetization[1] ($\delta_s$)—150 emu/g
Squareness ($\delta_r/\delta_s$)[2]—0.52

[1]measured at a field strength of 10,000 oersteds
[2] measured at a field strength of 5,000 oersteds The metallic particles produced in this example were used to form a magnetic tape in the following manner. A mixture of 70 grams of the metallic particles, 55 grams of tetrahydrofuran, 2.5 grams of soybean lecithin and 65 grams of a 15% solution of a thermoplastic polyurethane elastomer (Estane 5701) in tetrahydrofuran was charged to a 1-pint paint can containing 150 ml. of ⅛" stainless steel balls, and an additional 65 ml. of tetrahydrofuran were added to the charge to provide good wetting. The can was placed on a Red Devil paint shaker for 1¾ hours, after which time an additional 66 grams of the polyurethane solution, 5.7 grams of a 50% solution of an aromatic polyisocyanate (Mondur CB) in methyl isobutyl ketone/ethyl acetate (2/1) and 1.0 gram of a 5% solution of ferric acetylacetonate in tetrahydrofuran were added to the milled charge, and the can was returned to the shaker for 15 minutes. The resulting dispersion, following filtration, was applied as a coating to a length of 6¼" Mylar film using a Beloit knife coater with a 2 kilogauss orientation magnet at a film speed of 60 feet/minute. The coated film was air dried in a 13 foot drying tunnel at 88° C. and the dried tape was slit to ¼" width. The slit tape exhibited the following magnetic properties when measured in the machine direction with a vibrating sample magnetometer at a field strength of 10,000 oersteds:

Coercivity ($H_c$)—1000 oersteds
Remanence ($B_r$)—2520 gauss
Maximum Inductance ($B_m$)—3500 gauss
Squareness ($B_r/B_m$)—0.72

The tape performed well in audio and video applications.

What I claim and desire to protect by Letters Patent is:

1. In the process for producing acicular ferromagnetic metallic particles suitable for magnetic recording media by reducing acicular particles of iron oxide or iron oxide hydrate with a gaseous reducing agent, the improvement which comprises treating said iron oxide or iron oxide hydrate particles prior to the reducing step with a water-soluble phosphorus-containing compound and with at least one compound of a metal selected from the group consisting of cobalt, nickel and copper under conditions to provide on the surface of the oxide particles a coating containing, based on iron, from 0.1 to 5 atomic % of phosphorus and at least 0.1 atomic % of said metal, the atomic ratio of said metal to phosphorus ranging from 0.5:1 to 10:1.

2. The process of claim 1 in which the phosphorus compound is phosphoric acid.

3. The process of claim 2 in which the metal compound is a water-soluble salt, oxide or hydroxide.

4. The process of claim 3 in which the reducing agent is hydrogen.

5. The process of claim 4 in which a zinc compound is also present during the treating step.

6. The process of claim 5 in which the zinc compound is zinc oxide.

7. The process of claim 4 or 6 in which the treated particles are dehydrated at a temperature of 500° to 700° C. prior to reduction.

* * * * *